United States Patent [19]

Beach

[11] Patent Number: 4,520,922

[45] Date of Patent: Jun. 4, 1985

[54] CONTAINER FOR FLAT ARTICLES

[76] Inventor: Edward B. Beach, 5112 Williamsburg Blvd., Arlington, Va. 22207

[21] Appl. No.: 623,936

[22] Filed: Jun. 25, 1984

[51] Int. Cl.[3] ..... B65D 5/44; B65D 5/34

[52] U.S. Cl. ..... 206/44 R; 206/44.11; 206/45.18; 206/425; 229/16 D

[58] Field of Search ..... 206/45.18, 44 R, 44.11, 206/425, 444, 309; 229/33, 36, 16 D

[56] References Cited

U.S. PATENT DOCUMENTS

| | | | |
|---|---|---|---|
| 940,451 | 11/1909 | Ferry | 229/16 D |
| 1,907,630 | 5/1933 | Ward | 206/44.11 |
| 2,124,335 | 7/1938 | Klein | 206/44.11 |
| 2,126,461 | 8/1938 | Graham | 206/44.11 |
| 2,330,585 | 9/1943 | Holstein et al. | 206/44.11 |
| 2,827,162 | 3/1958 | Garman | 206/44 R |
| 3,286,830 | 11/1966 | Robb, Jr. | 206/264 |
| 4,369,879 | 1/1983 | Egly et al. | 206/425 |

*Primary Examiner*—William T. Dixson, Jr.

*Attorney, Agent, or Firm*—William F. Hamrock

[57] ABSTRACT

This invention relates to improvements in boxes, cartons and other similar containers which are used as combination shipping and storage containers convertible to display stands. The containers are formed from bendable material such as folded cardboard, folded paper or other bendable material. The containers are readily useful for storing flat articles and planar discs, such as floppy discs used with computers and other electronic equipment. The containers are converted to display stands by folding down the top wall section to fit inside the empty container to form a well so as to support the flat contents in an upright position.

20 Claims, 12 Drawing Figures

CONTAINER FOR FLAT ARTICLES

BACKGROUND OF THE INVENTION

The present invention deals with shipping and storage containers for flat articles and can be easily converted to display stands for ready viewing and easy accessibility of the displayed articles.

Flat articles of various materials have come into extensive use in many industries. For instance, planar discs which are commonly referred to as floppy discs are extensively used in the computer industry. There are other instances of discs, cards, records and various other flat articles that require shipping, storage and display and this invention includes all of these flat articles.

It would be highly advantageous and economical to be able to remove the contents from a container and to immediately display the articles by easily transforming the container into a display stand. This situation is especially true where the contents are flat articles that are to be exhibited for public sale, viewing or easy accessibility. This feature is particularly valuable as a quick and easy do-it-yourself for saving time, space and the expense of having a separate display stand.

There have been difficulties associated with packaging these flat articles. The standard packaging usually has been in cardboard containers. The difficulties with many conventional cardboard containers are that they are fragile and cumbersome and none are designed for adequately displaying the articles for easy viewing and easy accessibility. Because of these problems, plastic containers have appeared on the market. The plastic containers have solved some of the problems but they have failed to solve the problem of adequately displaying the flat articles as well as being expensive to manufacture when compared with foldable material such as cardboard or other bendable material.

Accordingly, it is the object of this invention to provide containers for various flat articles and planar discs which avoid many of the disadvantages of the prior art.

It is the primary object of this invention to provide cpmbination shipping, storage and display containers for flat articles and planar discs which are formed from foldable material such as cardboard, folded paper or other bendable material.

It is another object of this invention to provide said containers which are strong, durable, compact, good appearance and inexpensive to manufacture.

SUMMARY OF THE INVENTION

The above objects of this invention are accomplished by providing a container made from a bendable material such as cardboard, folded paper or similar materials which serves as a combination shipping and storage container and display stand and is constructed so as to be strong, durable, compact, inexpensive and has a good appearance.

In accordance with this invention there are disclosed containers for packaging flat articles and planar discs. The containers are convertible from shipping and storage containers for use as display stands for supporting and displaying all their contents in an upright position external to the containers. The dimensions of each carton are determined by the size and number of the flat articles and discs to be packaged as well as by the thickness of the container material itself.

The containers of the preferred embodiment of the invention have basically the same rectangular construction. In one preferred embodiment, the container is composed of a separate bottom element and a separate top element which fit together to form the container. The bottom element has a pair of side walls of equal length, a front and rear wall of equal length, and a bottom wall. The top element also has side walls, front and rear walls and a top wall which is about equal in size to the bottom wall. The top side walls differ from the bottom side walls by being of shorter length than the bottom side walls and terminate at longitudinal score lines across the top wall near the front of the container. This permits the container to be reconfigured by bending along the score lines and performing certain other bends and folds as required to create the display stand. By this process, the user first removes the flat contents from the container, then reconfigures the container by making the appropriate folds whereby the front section of the top wall is folded down along the score lines to form a wall substantially upright with respect to the bottom wall and spaced rearwardly of the bottom front wall a distance sufficient to support all of the contents in a well formed between said upright wall and said bottom front wall.

An unexpected improvement in the construction of the container arises from these score lines marked longitudinally across the top wall. By spacing these score lines a particular distance from the front of the container, and converting the container into the display stand, a well is formed having its newly formed rear wall high enough to support the flat contents in an upright position. The exact distance of the score lines from the front wall is determined by the dimensions of the container and the size of the flat contents.

The score lines in the top wall play no part whatever when used as a shipping and storage container. In this use, the top and bottom close together to contain and secure the contents within the container. It is the additional role of the container as a display stand that the scoring in the container top wall plays a role.

In two other preferred embodiments, the containers are constructed from single sheets of material. That type of construction results in the bottom rear wall and the top rear wall being one and the same. In one of said preferred embodiments, the bottom side walls have overlapping sections firmly secured in an upright position by inserting attached lock tabs into slots in the bottom wall; no adhesive is required for this embodiment. In the other preferred one piece embodiment, adhesive is used whereby the wall sections of the container are cemented together with adhesive.

There are no limitations as to the thickness of the walls of the container. The construction of the container permits the walls to be of any thickness desired resulting either from the thickness of one sheet of material or from sections joined together or cemented together to increase the wall thickness and produce strong, durable and compact walls.

In all embodiments, when closing the container, the top, rear and front walls, and the top side walls, when present, can be inserted either inside or outside the corresponding bottom walls. When the top front wall and/or rear wall wall are positioned outside the bottom, flaps can be appended to each end of the top front and/or rear wall which flaps fit inside the bottom side walls to provide a locking feature when the container is in a closed position.

The preferred embodiments of the invention are illustrated in the accompanying drawings.

Figure 1:
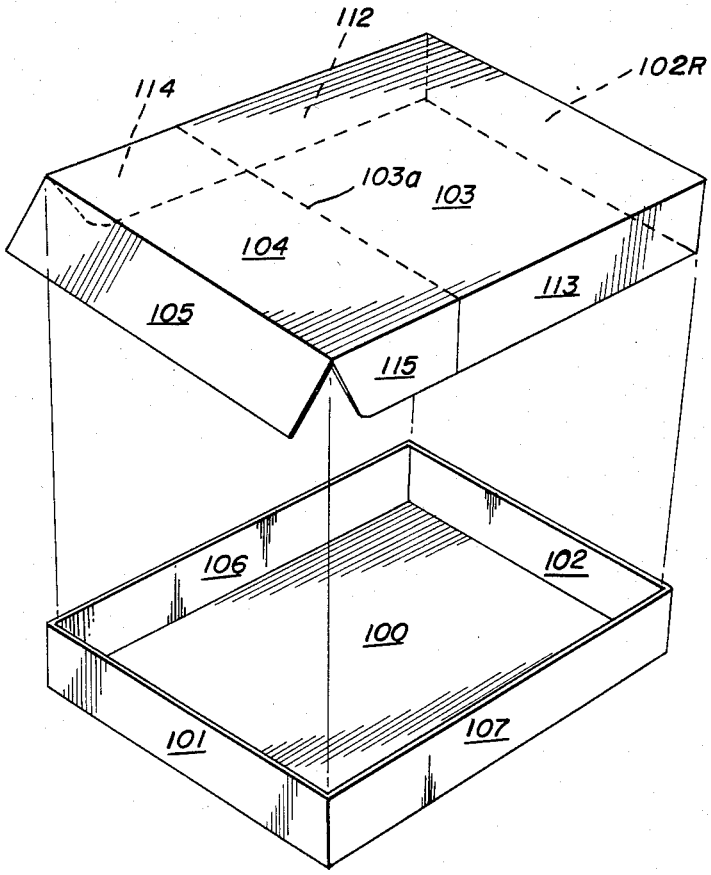
FIG. 1 is a perspective view of a top element of the container and of a bottom element of the container where the container is formed from separate top and bottom elements.

Referring to the drawings, the blank of FIG. 3 will be discussed initially and how it relates to its own embodiment in FIGS. 4–8 and to the other embodiments in FIGS. 1–2 and 9–12 of the invention. FIG. 3 shows a blank of a preferred embodiment of this invention and FIGS. 4–8 show how a container is formed from this blank of a single sheet of material. The blank of material includes a bottom wall 200 having a bottom front wall 201 and opposing rear wall 202, at its front and rear margins, designated by the longitudinal fold lines. Rear wall 202 has top wall section 203 hingedly attached to its top margin. Top wall section 204 is hingedly attached to top wall section 203 at score lines 203*a*. Top front wall 205 is hingedly attached to top wall section 204.

Bottom front wall 201 and rear wall 202, and top front wall 205, are substantially the same size and shape, as are bottom wall 200 and combined top wall sections 203 plus 204 substantially the same size and shape when used as a container. Top wall section 203 is larger than section 204, and the exact location of score line 203*a* separating and determining the size of these two sections is dependent on the dimensions of the container and the size of the flat contents that are to be displayed and supported in an upright position.

Figure 6:
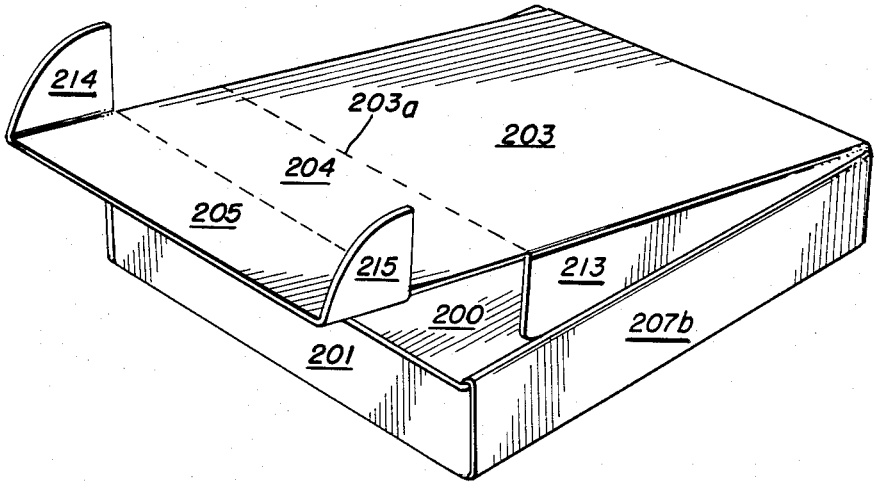
FIG. 6 is a left side perspective showing how the top side walls are folded inside the bottom portion of the container.
Figure 7:
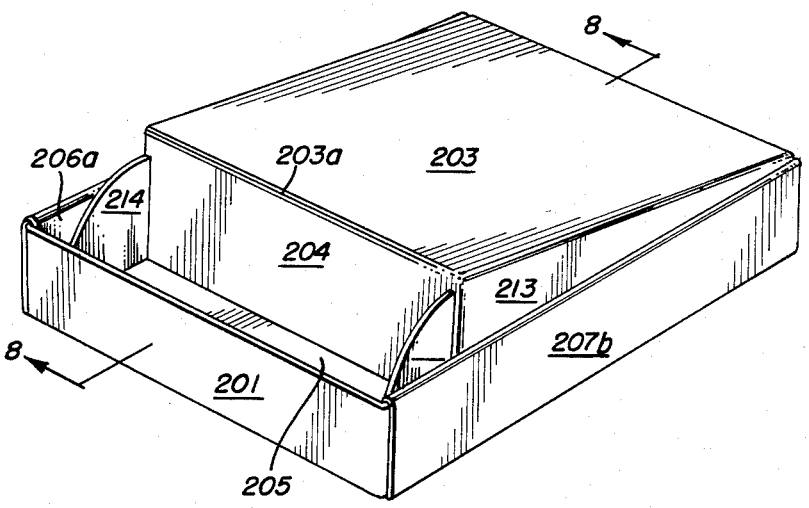
FIG. 7 is a left side perspective showing the container in its fully assembled state.
Figure 8:
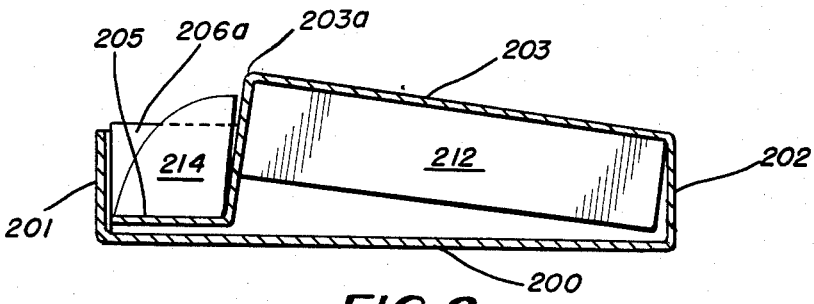
FIG. 8 is a horizontal cross section taken on lines 8—8 of FIG. 7 showing how the front of the container is folded down to form the display well.

Hingedly attached to the opposite ends of top front wall 205, are a pair of foldable flaps 214 and 215 which fold inwardly to fit within the bottom section side walls 206 and 207 to lock the container closed when used as a shipping and storage container and which fold outwardly inside the well formed when the container is used as a display stand. FIGS. 6–8 illustrate how said flaps are folded parallel to the bottom side walls in forming the display well.

Top side wall sections 212 and 213 are joined to top wall section 203. These top side wall sections are substantially the same size and shape and fit inside the bottom side walls 206 and 207 when the container is closed. Top side wall sections similar to 114 and 115 of FIG. 1 are optional for the embodiments of FIGS. 3–12 and could be included if desired.

Inwardly foldable rectangular flaps 210 and 211, and 208 and 209, are the same size and shape and are hingedly attached to the opposite ends of rear walls 202 and front bottom wall 201, respectively. Flaps 210 and 211 combine with flaps 208 and 209 within the bottom wall assemblies 206 and 207 and provide additional wall thickness and support to the bottom side walls as illustrated in FIGS. 4–5.

Each of the bottom side walls 206 and 207 contains two sections 206*a* and 206*b*, and 207*a* and 207*b*, respectively, which are joined at transverse fold lines. The inner side wall sections 206*b* and 207*b* are hingedly attached to the sides of bottom wall 200. Lock tabs t1, t2, t3 and t4 on the outside edges of the outer end wall sections 206*a* and 207*a* operate to hold the bottom side walls securely in place in upright positions by insertion in the slots 200*a*, 200*b*, 200*c* and 200*d* of bottom wall 200 as shown in FIG. 4.

Figure 3:
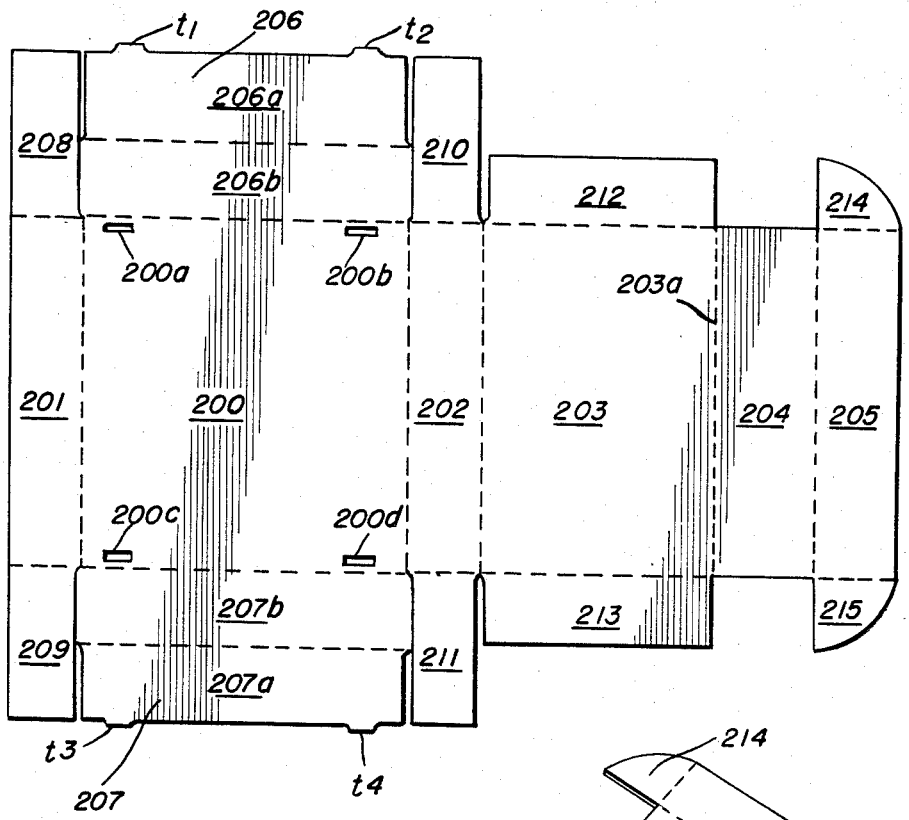
FIG. 3 is a top plan view of the blank from which a container is formed from a single sheet of material.
Figure 4:
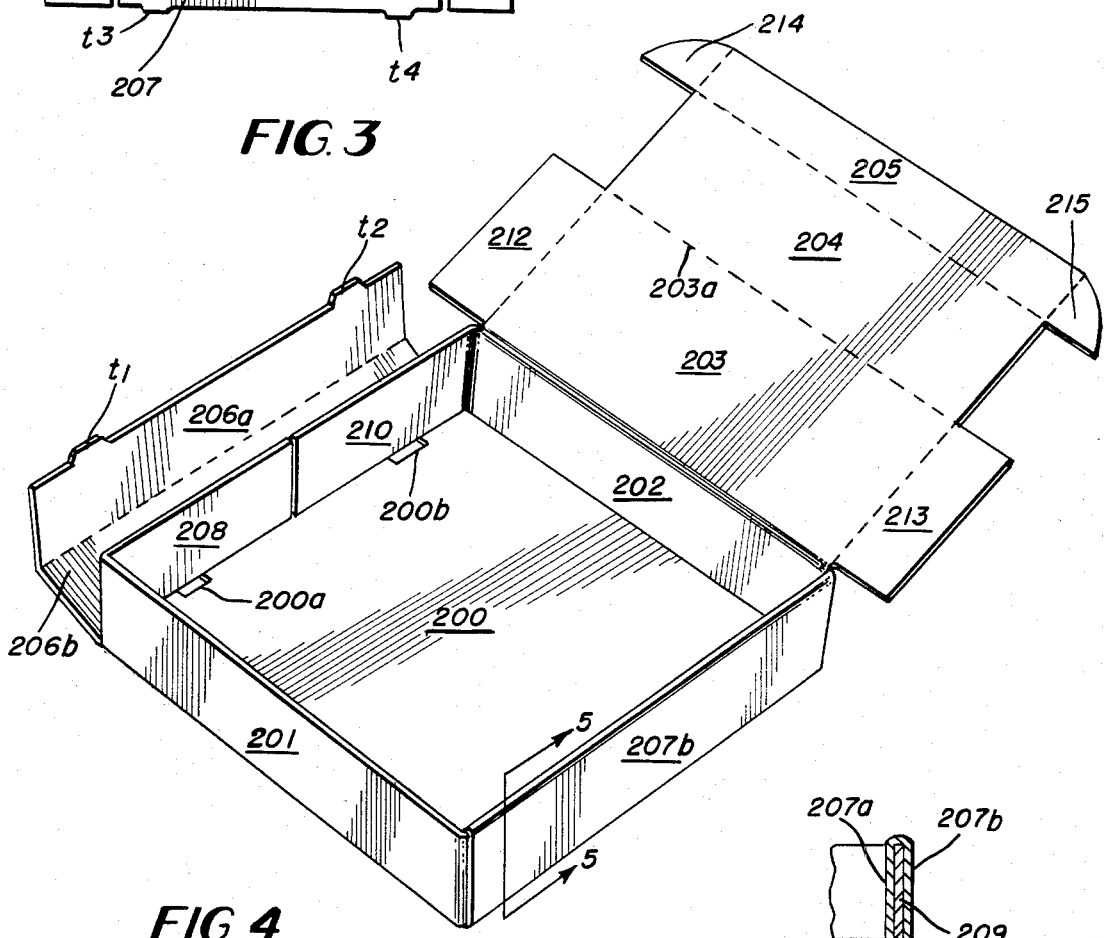
FIG. 4 is a perspective view of the container in the partially folded configuration with the top open.

The container is assembled from the blank of FIG. 3 as illustrated in FIG. 4 by first folding bottom front wall 201 to an upright position and at the same time folding inwardly flaps 208 and 209 at right angles to the uprighted front wall 201. At the same time rear wall 202 is then folded to an upright position opposite front wall 201 folding inwardly flaps 210 and 211 at right angles to uprighted rear wall 202 whereby flaps 210 and 211 just about come in contact with corresponding flaps 208 and 209. When corresponding end flaps 208 and 210 are about in contacting upright positions, bottom side wall section 206*b* is folded upwardly along the folding lines, side wall section 206*a* is then folded down over flaps 208 and 210 and is locked in place by inserting its lock tabs t1 and t2 in slots 100*a* and 100*b* of bottom wall 200. At this point, flaps 208 and 210 are bound within bottom side wall sections 206*a* and 206*b* creating a bottom side wall of triple thickness resulting in strong, sturdy wall.

Figure 5:
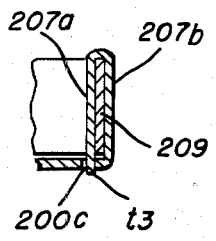
FIG. 5 is a cross sectional view taken on lines 5—5 of FIG. 5 showing how the locking tabs are inserted through the bottom wall of the container to lock the bottom side walls in an upright position.

The same procedure is followed in forming the corresponding opposite bottom side wall and illustrated in FIG. 5 whereby with corresponding end flaps 209 and 211 are in about contacting positions, bottom side wall section 207*b* is folded upwardly along the folding lines, side wall section 207*a* is folded down over flaps 209 and 211 and is locked in place by inserting its lock tabs t3 and t4 in slots 200*c* and 200*d* of bottom wall 200.

The container is formed into a shipping and storage container by folding downwardly the top side wall sections 212 and 213 and inserting them inside bottom side walls 206 and 207. The container is then closed and locked in place by folding down the top front wall 205 over the bottom front wall 201 while folding flaps 214 and 215 and inserting them into the pocket created by bottom inner side wall section 206*b* and 207*b* and bottom front wall rectangular flaps 208 and 209, respectively.

FIGS. 6–8 illustrate the process of a container having been transposed into a display stand from the blank of FIG. 3. To form the display stand of FIGS. 7–8, the top wall side sections 212 and 213 are placed inside the bottom side walls 206 and 207. If optional top side wall sections similar to 114 and 115 of FIG. 1 had been present said optional wall sections would have been folded and placed inside and along-side bottom side walls sections 206*a* and 207*a*. The top wall section 204 is folded down along the score lines 203*a* inside the container to form an upright wall with respect to the bottom wall 200. The top front wall 205, attached to said top wall section 204, is folded down so as to lie flat on bottom wall 200 touching front wall 201 thereby forming a well within the container. Flaps 214 and 215, folded outwardly, fit alongside bottom side wall sections 206*a* and 207*a* inside the container. The display well is formed by a back support rest (top wall section 204), bottom support (top front wall section 205), side support (flaps 214 and 215) and front support (bottom front wall 201). The display well is held in position by friction of the side supports (214 and 215) against the internal surfaces of the bottom side wall sections 206*a* and 207*a* and of the bottom support (top front wall 205) against the front support of the well bottom front wall 201 and the bottom wall 200. When the height of the back support rest 204 is greater than the height of the bottom side walls, 206 and 207, it results in the back support rest 204 being in a slightly inclined position. The height of the back support 204 can be equal to or greater than the height of the bottom side walls 206 and 207 and is determined by the dimensions of the carton and the size of the contents to be supported for display for ready viewing and easy access as illustrated in FIGS. 7–8 for this embodiment and in FIG. 2 and FIGS. 11–12 for other embodiments.

Shown in FIG. 1 is a preferred embodiment showing the construction of a container having a separate top and bottom element whereby the container is formed by placing the top element inside the bottom element. The bottom element includes a bottom wall 100, front wall 101, rear wall 102 and side walls 106 and 107. The top element includes top sections 103 and 104 connected through score lines 103*a*, front wall 105 and rear wall 102R and side walls 112 and 113.

Figure 2:
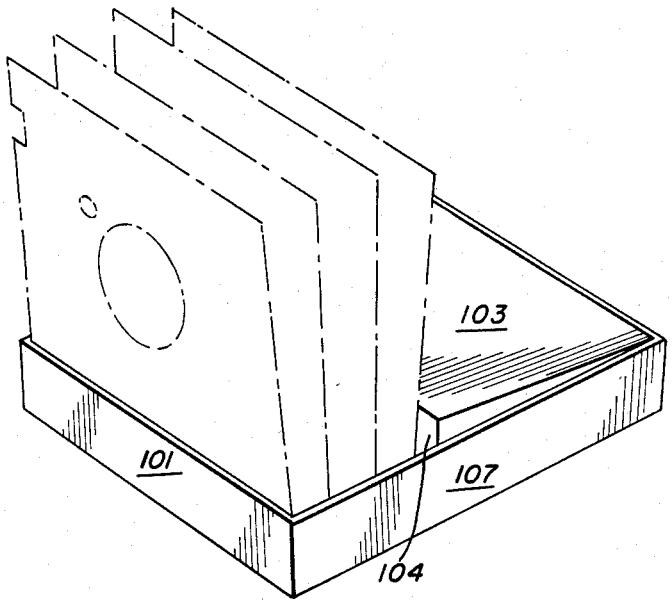
FIG. 2 is a perspective view showing the container after forming the display well and displays upright the flat floppy disc contents.

FIG. 2 illustrates the container of FIG. 1 having been converted to a display stand displaying flat planar articles which are readily viewable and can be easily removed.

Figure 9:
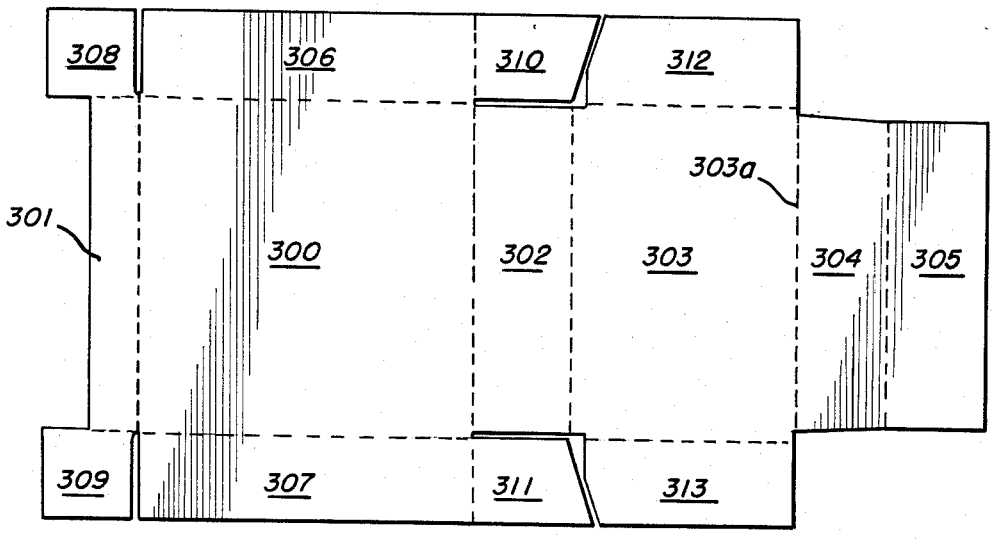
FIG. 9 is a top plan view of the blank of another embodiment.
Figure 10:
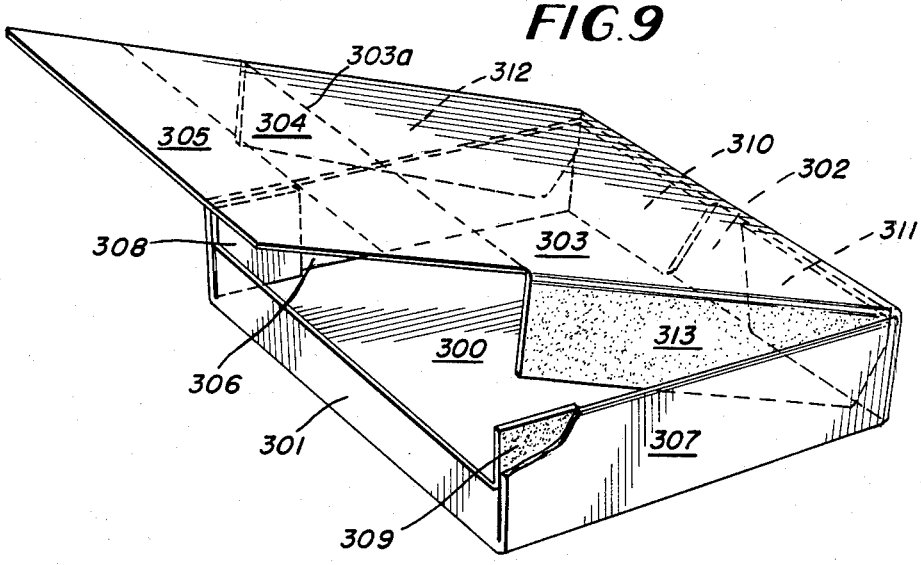
FIG. 10 is a left side perspective of said embodiment with the sides folded and the top partially closed; the stippled portions represent adhesive.
Figure 11:
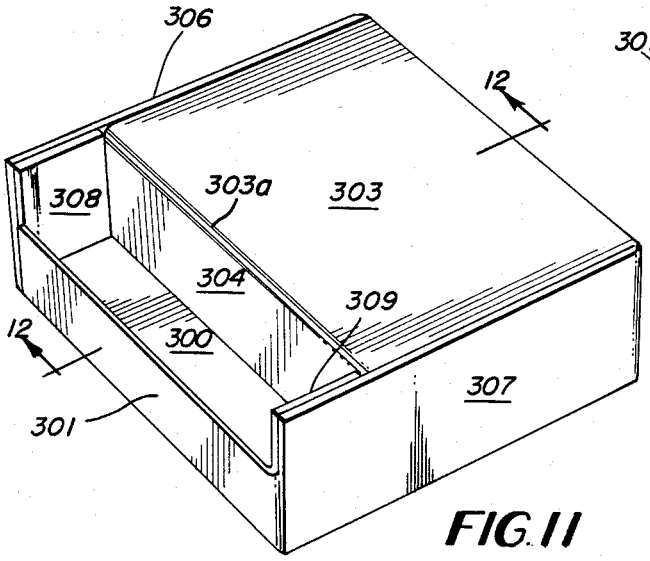
FIG. 11 is a left side perspective of said embodiment showing the completed assembly.
Figure 12:
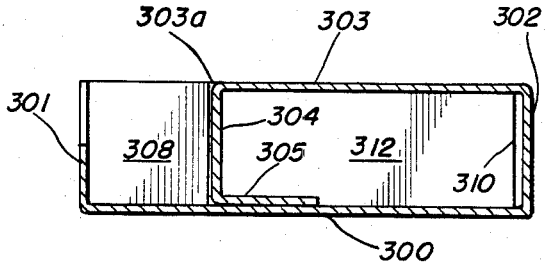
FIG. 12 is a cross section taken of lines 12—12 of FIG. 11.

Shown in FIG. 9 is a blank of another preferred embodiment of this invention and FIGS. 10–12 illustrate the construction of the container and display stand from said blank. The blank of material includes a bottom wall 300, front 301 and rear 302 walls. Attached to rear wall 302 is top wall section 303 which has top wall section 304 attached at score lines 303*a*. Top front wall 305 is hingedly attached to top wall section 304.

Bottom front wall 301 is longitudinally cut-off about one-half the height of the rear wall and side walls for easier viewing and access to the flat contents as shown in FIG. 11. Rear wall 302 and top front wall 305 are substantially the same size and shape and bottom wall 300 and combined top wall sections 303 and 304 are substantially the same size and shape when used as shipping and storage container. As in previous embodiments, top wall section 303 is larger than 304 and the size is determined by the location of score lines 303*a*.

Hingedly attached to the opposite ends of top section 303 are top side wall sections 312 and 313. These top side wall sections are substantially the same size and shape and fit inside and are cemented to bottom side wall sections 306 and 307 as shown in FIG. 10.

Flaps 310 and 311 are the same size and shape and are attached to bottom side walls 306 and 307. The flaps fold inwardly and are cemented to rear wall 302 as shown in FIG. 10, Bottom side walls 306 and 307 are the same size and shape and are attached to bottom wall 300. These bottom side walls are cemented to top side walls 312 and 313 in forming the container as illustrated in FIGS. 10–12. Flaps 308 and 309 are the same size and shape and are attached to bottom front wall 301. Said flaps fold inwardly and are cemented to bottom side walls 306 and 307 as shown in FIGS. 10–12.

The container of the blank of FIG. 9 is assembled as illustrated in FIGS. 10–12. The bottom front wall 301 is folded to an upright position and flaps 308 and 309 are folded inwardly at right angles to said front wall. Bottom side walls 306 and 307 are folded to an upright position in contact with flaps 308 and 309 and flaps 310 and 311 are folded inwardly at right angles to said side walls; rear wall 302 is brought to an upright position in contact with flaps 310 and 311. Flaps 308 and 309 are cemented to bottom side walls 306 and 307 and flaps 310 and 311 are cemented to rear wall 302 to form the bottom portion of the container.

The container is formed into a shipping and storage container by folding downwardly top side wall sections 312 and 313 and inserting them inside and cementing them to bottom side walls 306 and 307 as shown in FIG. 10. The container is closed and locked by folding down top front section 305 either inside or outside bottom front wall 301.

FIGS. 11 and 12 illustrate the process of the container having been converted to a display stand from the blank of FIG. 9. To form the display stand and well, top wall section 304 is folded down along the score lines 303*a* inside the container to form an upright wall 304 with respect to the bottom wall 300 as in the other preferred embodiments. The attached front wall 305 can be folded into the enclosed container forming the well as shown in FIG. 12. It is to be emphasized that front wall 305 could have been folded outwardly towards front wall 301 and lie on top of bottom wall 300 just touching front wall 301 as in the other embodiments.

While the invention has been described in terms of the preferred embodiments the following claims are intended to encompass all embodiments which fall within the scope of the invention.

What is claimed is:

1. A shipping and storage container for shipping and storing flat articles said container formed from foldable material and capable of being convertible to a display stand comprising a. a bottom wall having opposing, upright front and rear walls extending upwardly from said bottom wall and having opposing, upright side walls extending upwardly from said bottom wall, and b. a top wall covering the container comprising a front section and a rear section said front section being hingedly attached to said rear section at longitudinal score lines, whereby said container being convertible to a display stand by folding down said top front wall section along said score lines to form a wall substantially upright with respect to the bottom wall and spaced rearwardly of said front wall a distance sufficient to support all the flat contents in an upright position in a well formed between the newly formed upright wall and said front wall.

2. The container as defined in claim 1 comprising said top wall having opposing side wall sections extending from the rear and terminating at said score lines.

3. The container as defined in claim 2 comprising a second pair of opposing top side wall sections extending from said score lines and terminating at the front of the container.

4. The container as defined in claim 3 comprising a separate bottom element and a separate top element.

5. The container as defined in claim 4 comprising opposing front and rear walls for said top element.

6. The container as defined in claim 2 comprising a front wall attached to said top wall.

7. The container as defined in claim 6 comprising overlapping bottom side walls locked in the upright position by attached tabs inserted into slots in said bottom wall.

8. The container as defined in claim 7 comprising opposing rectangular flaps attached to each end of said bottom front and rear walls whereby said rectangular flaps being enclosed in an upright position between said overlapping side walls.

9. The container as defined in claim 8 comprising opposing flaps attached to each end of said top front wall whereby said flaps fit between said overlapping side walls to lock the container closed.

10. The container as defined in claim 9 converted to the display stand comprising folding down and towards the front said top front wall so as to lie flat on the bottom wall and folding up said flaps alongside the side walls within the display well so formed.

11. The container as defined in claim 10 comprising forming the container from a single sheet of foldable material.

12. The container as defined in claim 6 comprising the top wall sections are cemented to the bottom wall sections.

13. The container as defined in claim 2 comprising forming the container from cardboard.

14. The container as defined in claim 12 converted to the display stand comprising folding down said top front wall towards the rear so as to lie flat on the bottom wall inside the enclosed area of the display stand.

15. The container as defined in claim 14 comprising said bottom front wall being about one-half tha height of the side walls.

16. The container as defined in claim 2 comprising walls of multiple thickness.

17. The container as defined in claim 16 comprising cemented multiple thickness walls.

18. The container as defined in claim 5 comprising forming the container from cardboard.

19. The container as defined in claim 10 comprising forming the container from cardboard.

20. The container as defined in claim 15, comprising forming the container from cardboard.

* * * * *